US005574484A

United States Patent [19]

Cowger

[11] Patent Number: 5,574,484

[45] Date of Patent: Nov. 12, 1996

[54] LEVEL DETECTION FOR INK CARTRIDGES OF INK-JET PRINTERS

[75] Inventor: Bruce Cowger, Corvallis, Oreg.

[73] Assignee: Hewlett-Packard Company, Palo Alto, Calif.

[21] Appl. No.: 360,911

[22] Filed: Dec. 20, 1994

[51] Int. Cl.[6] ..... B41J 2/175

[52] U.S. Cl. ..... 347/7; 340/620

[58] Field of Search ..... 347/7; 340/620

[56] References Cited

U.S. PATENT DOCUMENTS

| | | | |
|---|---|---|---|
| 4,422,084 | 12/1983 | Saito | 347/7 |
| 4,475,116 | 10/1984 | Sicking et al. | 347/7 |
| 4,490,997 | 7/1990 | Hamlin et al. | 347/7 |
| 4,604,633 | 8/1986 | Kimura et al. | 347/7 |
| 4,779,104 | 10/1988 | Lawrence et al. | 347/7 |
| 4,922,268 | 5/1990 | Osborne | 347/7 |
| 4,935,751 | 6/1990 | Hamlin | 347/7 |
| 4,973,993 | 11/1990 | Allen | 347/7 |
| 5,079,570 | 1/1992 | Mohr et al. | 347/7 |
| 5,132,711 | 7/1992 | Shinada et al. | 347/7 |

*Primary Examiner*—Valerie A. Lund

[57] ABSTRACT

The level of ink present in an ink-supply cartridge of an ink-jet type printer is detected by a sensor that moves with the reciprocating pen carriage of the printer. A flag is connected to the collapsible supply cartridge so that the flag position changes relative to the path of the carriage movement as ink is depleted from the cartridge. The sensor detects the presence of the flag and the position change of the flag is precisely measured by the carriage motion control system. An indicition of the cartridge level derived from the flag position is provided.

13 Claims, 5 Drawing Sheets

LEVEL DETECTION FOR INK CARTRIDGES OF INK-JET PRINTERS

TECHNICAL FIELD

The present invention is directed to a system for detecting the level of ink present in the supply container of an ink-jet type printer.

BACKGROUND INFORMATION

One type of ink-jet printer includes a carriage that is reciprocated across a sheet of paper that is advanced through the printer. The reciprocating carriage holds an ink-jet pen very close to the paper. The pen is controlled by the printer for selectively ejecting ink drops from the pen while the pen moves across the paper, thereby to produce characters or an image on the paper.

The pen has a reservoir for holding a limited amount of ink. A relatively larger supply of ink is provided in a replaceable stationary container or cartridge that is mounted within the printer. A tube may be connected between the supply cartridge and the pen, thereby to conduct the flow of ink from the supply cartridge to the pen for replenishing the pen reservoir as needed.

An efficient and easy-to-use printer will include mechanisms that permit rapid replacement of a depleted collapsible cartridge without ink leakage from either the depleted cartridge or the full cartridge that is used as a replacement. Such a printer will also include a system for detecting the amount of ink in the stationary cartridge so that the printer may provide a signal that is indicative of the amount of ink remaining in a cartridge.

SUMMARY OF THE INVENTION

The present invention is directed to a system for detecting the level of ink in a collapsible ink-supply cartridge. The ink-level detection system may be used in conjunction with a station that secures the cartridge to the printer and that facilitates rapid and leak-free replacement of the cartridges.

DESCRIPTION OF A PREFERRED EMBODIMENT

Figure 1:
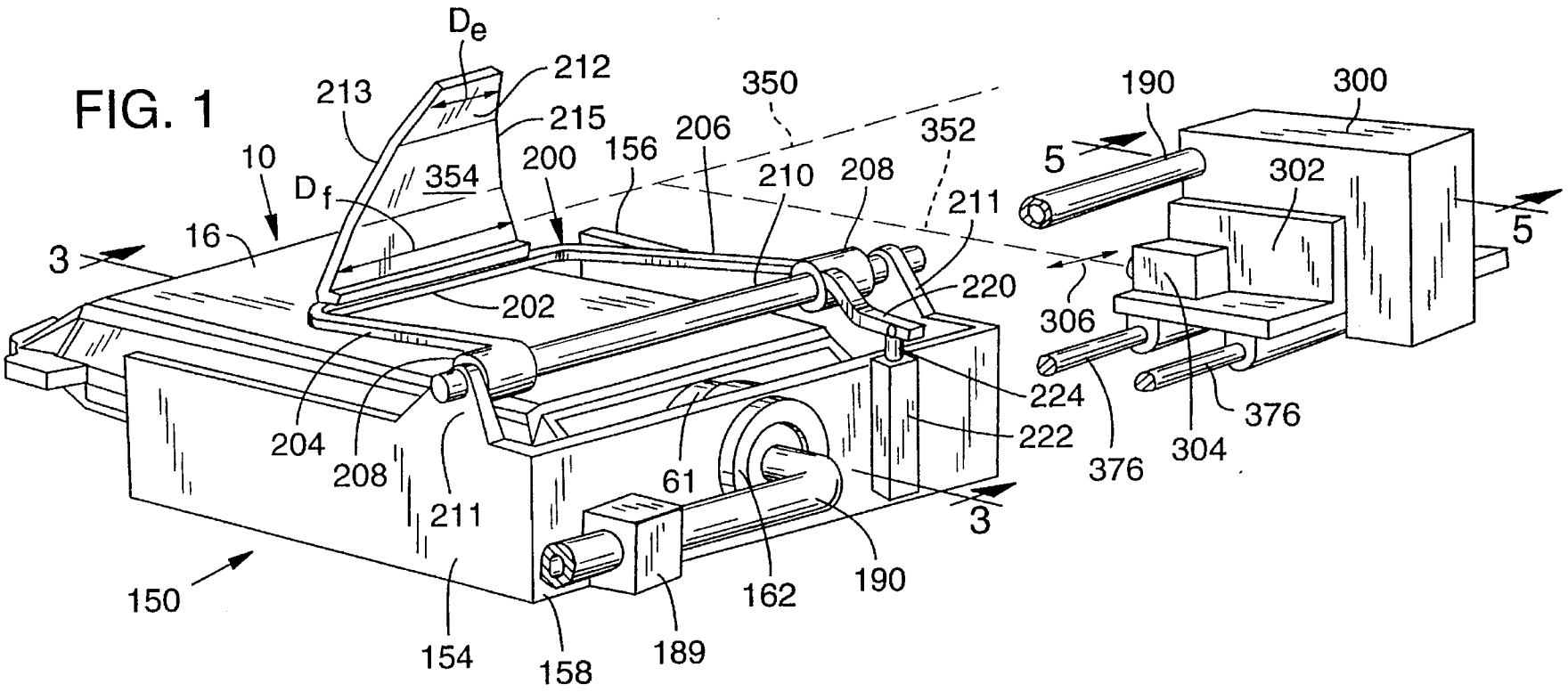
FIG. 1 is a perspective view of the primary components of the level detection system of the present invention.
Figure 2:
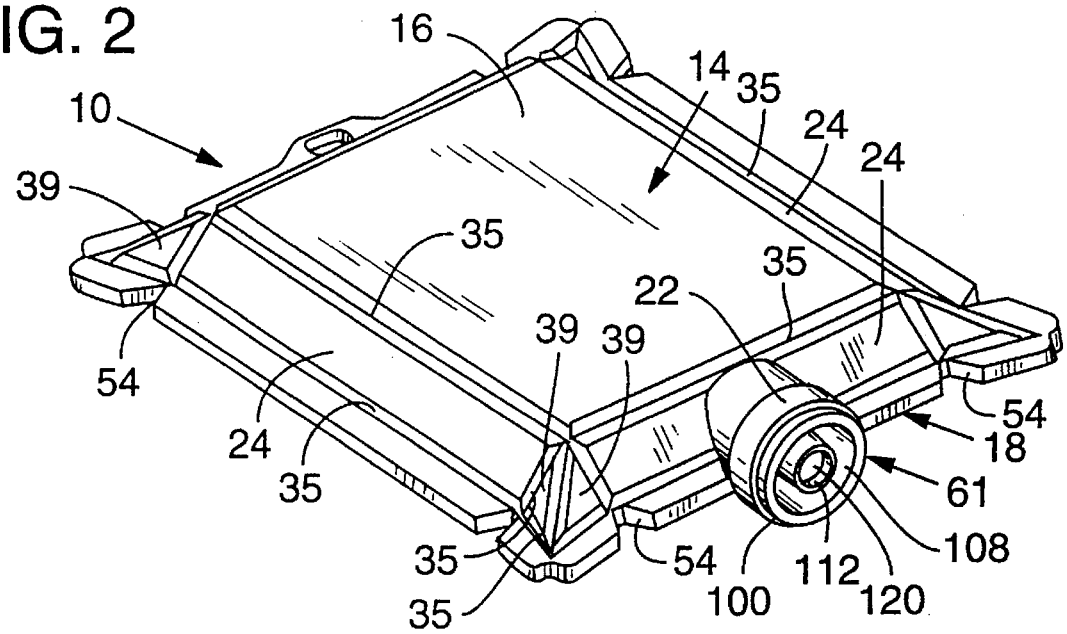
FIG. 2 is a perspective view of a collapsible ink cartridge that may be employed with the system.
Figure 3:
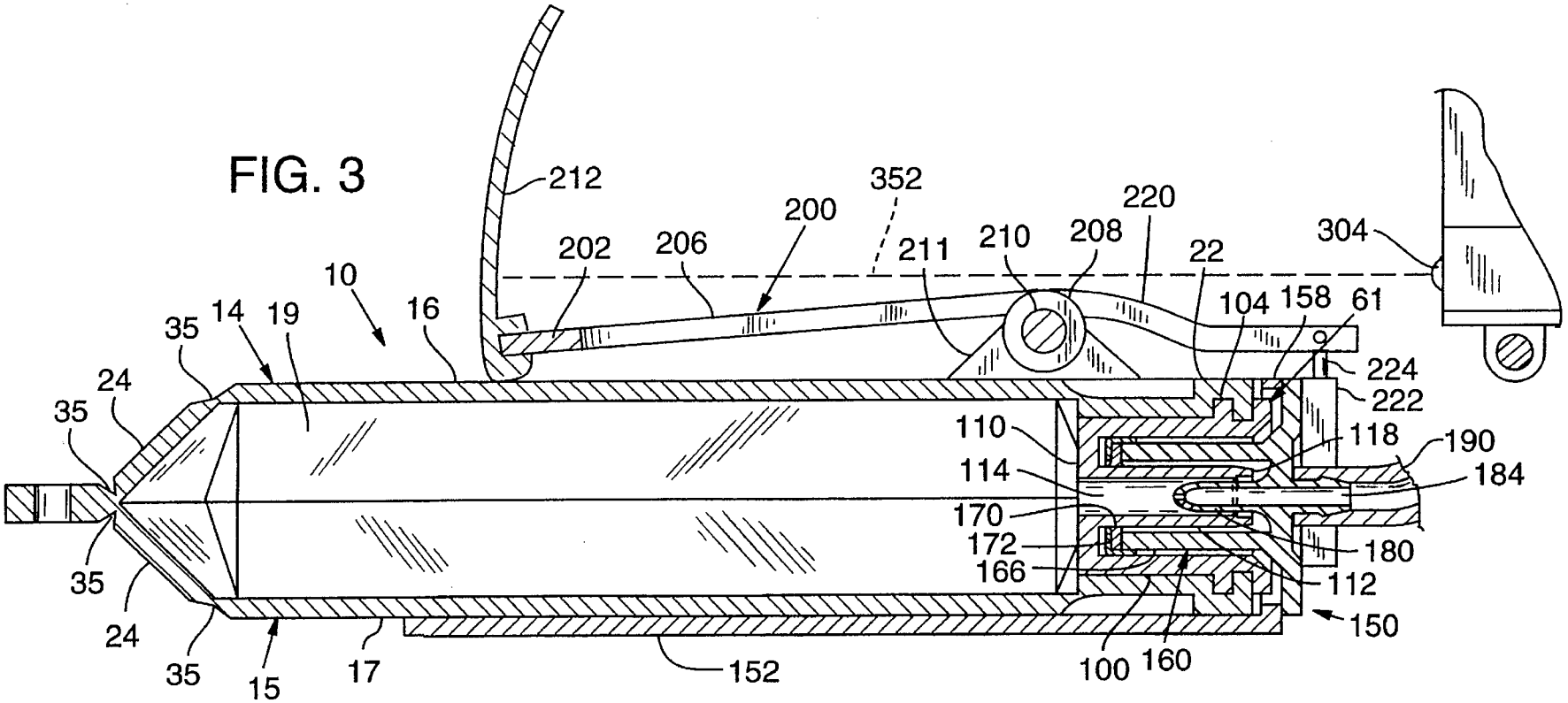
FIG. 3 is a side view of the system, partly in section, showing a substantially full ink cartridge.

A system in accordance with a preferred embodiment of the present invention may be used in conjunction with a collapsible cartridge, as designated in FIGS. 1–4 with reference numeral 10. The ink cartridge 10 includes two substantially identical opposing upper and lower panel assemblies 14, 15 (FIG. 3). As shown in FIGS. 2 and 3, the panel assemblies 14, 15 respectively include a relatively large, square-shaped planar upper panel 16, and lower panel 17. The panels 16, 17 define the top and bottom of the cartridge 10.

The panel assemblies 14, 15 are joined at a square-shaped frame 18 and are symmetrical about a central plane defined by the frame 18. A hinge member 24 is connected between each edge of the upper and lower panels 16, 17 and the corresponding edge of the frame 18. As best shown in FIG. 2, the junctions of the frame 18 with the hinge members 24 and the junctions of the upper and lower panels 16, 17 with the hinge members include grooves that define flexible hinges 35. The hinges facilitate movement of the upper panel 16 and lower panel 17 toward one another as the cartridge 10 collapses due to depletion of ink from the interior cavity 19 of the cartridge.

A pair of triangular-shaped hinge members 39 and associated hinges 35 join the ends of the hinge members 24 at each of the four corners of the frame 18. Notches 54 are formed in the frame 18 to permit the slight expansion of the frame that occurs as the cartridge collapses.

One side of the frame 18 includes a fitment 61 through which ink may be conducted into and out of the cartridge (FIG. 2). With particular reference to FIGS. 2 and 3, the fitment 61 includes a cylindrically shaped sleeve 100 that is bonded, as by heat welding, into a correspondingly shaped opening that is molded into the frame 18. In this regard, the frame is essentially bifurcated into a top part 22 and a bottom part 23. The top part 22 wraps around the top half of the sleeve 100 and the bottom part 23 wraps around the bottom half of the sleeve. In a preferred embodiment, the portions of the frame facing the sleeve 100 have formed within them a rabbet groove into which fits an annular tongue 104 that protrudes from the sleeve.

The outer end of the sleeve is chamfered 108 (FIG. 1) to facilitate mating of the fitment with a coupler 160, as described below. The inner end 110 of the sleeve 100 (FIG. 3) is shaped to define a spout 112 that extends inside the sleeve along the axis of the sleeve and protrudes from the inner end 110 to a location just inside the outer end of the sleeve. The spout 112 has an inner passage 114 that is open to fluid communication with the cavity 19 of the cartridge 10. Near the outer end 118 of the spout 112 the passage 114 is occluded by a pierceable septum 120 (FIG. 1) that remains in place until pierced by the coupler as explained below. Accordingly, the ink within the cavity 19 is sealed from ambient until the filled cartridge is coupled to the station in the printer.

A cartridge 10 is placed by the user into a station 150 that is carried in the printer. The station 150 includes means for supporting the cartridge 10, coupling the cartridge with a tube that conducts the ink from the cartridge to an ink-jet pen, and applying pressure to the cartridge for moving ink from the cartridge through the tube.

More particularly, a preferred embodiment of the station 150 includes a bottom wall 152 on which may rest the square-shaped panel 16 or 17 of a cartridge 10. The cartridge 10 fits between two upwardly protruding side walls 154, 156 of the station, with the fitment 61 of the cartridge facing, an end wall 158 of the station. The end wall 158 has mounted to it the above-mentioned coupler 160.

The coupler 160 includes a mounting ring 162 that is fastened across the edge of an aperture formed in the end wall 158 of the station. A generally tubular connector 166 protrudes from the wall 158 into the station, spaced from the bottom wall 152. A resilient sealing ring 170 is mounted, such as by swaging with an annular metal channel member 172, to the innermost end of the connector 166. The resilient sealing ring 170 has an inside diameter slightly less than the outside diameter of the cartridge spout 112, thereby to seal the connector to the spout during the time the cartridge 10 is joined to the coupler 160 (FIG. 3).

The coupler 160 is shaped to define a hollow needle 180 that protrudes inwardly from the mounting ring 162 inside the connector 166 for a distance of about halfway through the length of the connector. The needle 180 includes an orifice 182 formed through its outermost end. The outside diameter of the needle 180 is less than the inside diameter of the passage 114 so that the needle fits inside of the passage. As the cartridge fitment 61 is moved against the coupler, the needle pierces through the septum 120 so that fluid communication is provided between the passage 114 and the interior 184 of the needle, through the orifice 182.

The interior 184 of the needle is contiguous with that of a tube fitting that protrudes outwardly from the mounting ring 162. A flexible tube 190 has one end attached to the tube fitting. As described more fully below, the other end of the tube 190 is connected to the reservoir of an ink-jet pen 300 that is reciprocated by a carriage 302 and controlled for directing ink drops onto paper that is advanced through the printer.

In view of the foregoing, it will be appreciated that whenever the cartridge fitment 61 is pushed against the coupler 160, the sealing ring 170 will engage the exterior surface of the spout 112. The needle 180 is inserted into the spout to pierce through the septum 120, thereby to permit ink to flow from the cartridge cavity 19, through the needle orifice 182, through the needle interior 184, and into the tube 190.

The cartridge 10 is filled with ink in the full configuration depicted in FIG. 3. Preferably, the cartridge 10 is plastic, and molded in the full configuration so that a collapsed cartridge tends to resile toward the full configuration.

A spring-biased pressure bar 200 is carried by the station 150 for forcing together the upper panel 16 and lower panel 17 of the cartridge 10 thereby to move ink out of the cartridge. More particularly, the pressure bar 200 is a generally U-shaped member with its base 202 extending across the station between the side walls 154, 156. The legs 204, 206 of the bar extend from opposite ends of the base 202. The ends of the legs 204, 206 each join a spring hinge 208. The spring hinges 208 urge the base 202 toward the bottom wall 152 of the station. The spring hinges 208 are carried by a support rod 210 that extends substantially across the width of the station near the end wall 158. Support brackets 211 are connected between the respective side walls 154, 156 and corresponding ends of the support rod 210 to secure the pressure bar 200 to the station 150.

In a preferred embodiment, the downward force of the bar may be automatically removed whenever the pen is in an inactive state; that is, when there is no requirement for forcing ink through the tube 190 to the pen. As noted earlier, removal of the force permits the resilient ink cartridge 10 to move toward the full configuration, thereby establishing a slight back pressure for preventing ink from leaking through the cartridge or through the attached tube 190. Accordingly, lever 220 is attached to extend from one hinge 208 near one leg 206 of the bar 202 to protrude generally horizontally across the station end wall 158. A conventional solenoid-type actuator 222 is mounted to the end wall 158 so that the associated extendable and retractable actuator rod 224 is pivotally coupled to the end of the lever 220. A suitable control signal is provided to the actuator 222 whenever the pen is made inactive so that the actuator rod 224 will retract (downwardly, in FIG. 3) by an amount sufficient for overcoming the force of spring hinges 208, thereby to remove the pressure applied by the bar 200.

A thin plastic flag 212 is attached to the base 202 of the pressure bar 200. The flag 212 is configured and arranged to operate in conjunction with an optoelectronic sensor 304 that is mounted to the pen carriage 302 to provide the ink level detection system of the present invention.

Figure 5:
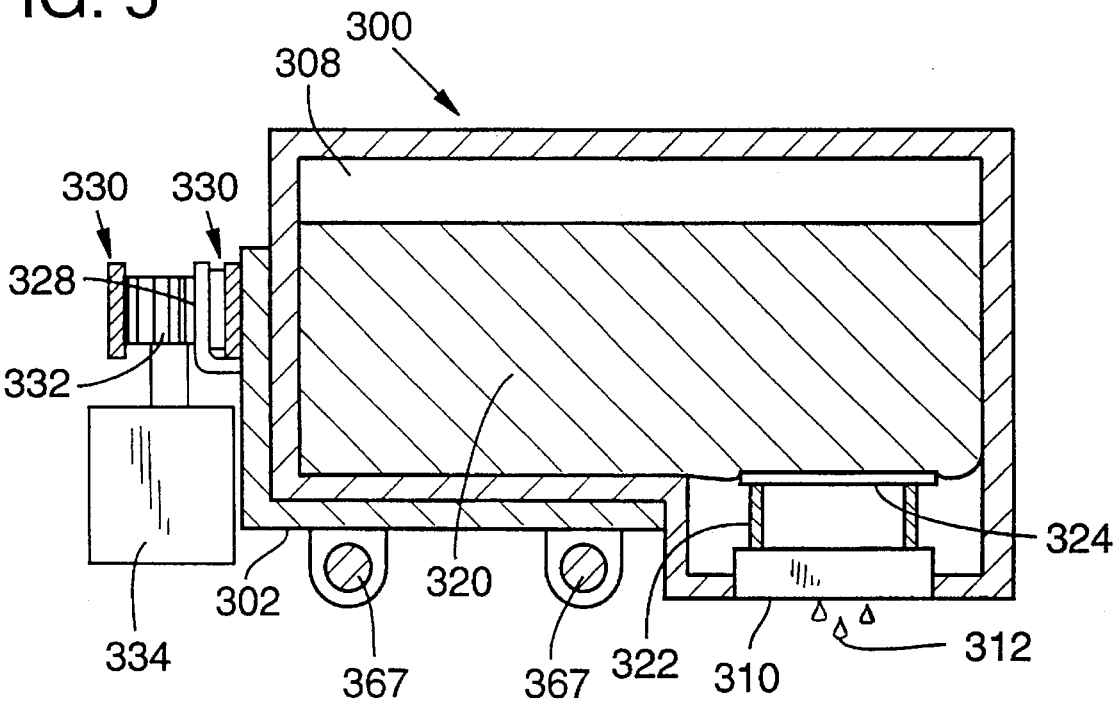
FIG. 5 is a cross-section view of an ink-jet pen and carriage with which the present system may be used.

Turning first to the particulars of the ink-jet pen 300 and carriage 302, and with particular reference to FIGS. 1 and 5, the ink-jet pen 300 is mounted to the carriage 302 and scanned back and forth across paper that is advanced through a printer. The path of the reciprocating carriage is a linear one, designated by arrow 306 in FIG. 1.

The pen 300 may be any one of a number of designs generally comprising a reservoir 308 that holds a relatively small volume of ink in fluid communication with a print head 310 (FIG. 5) that is carried on the underside of the pen.

The print head 310 may be a thermal-type that employs a plurality of thin-film resistors, each resistor being located along a channel of ink and adjacent to a nozzle formed in the print head. The resistors are selectively fired (heated) for expanding a small volume of ink that is adjacent to the resistor. The ink expansion forces a drop of ink 312 (shown greatly enlarged) through the nozzle.

Figure 6:
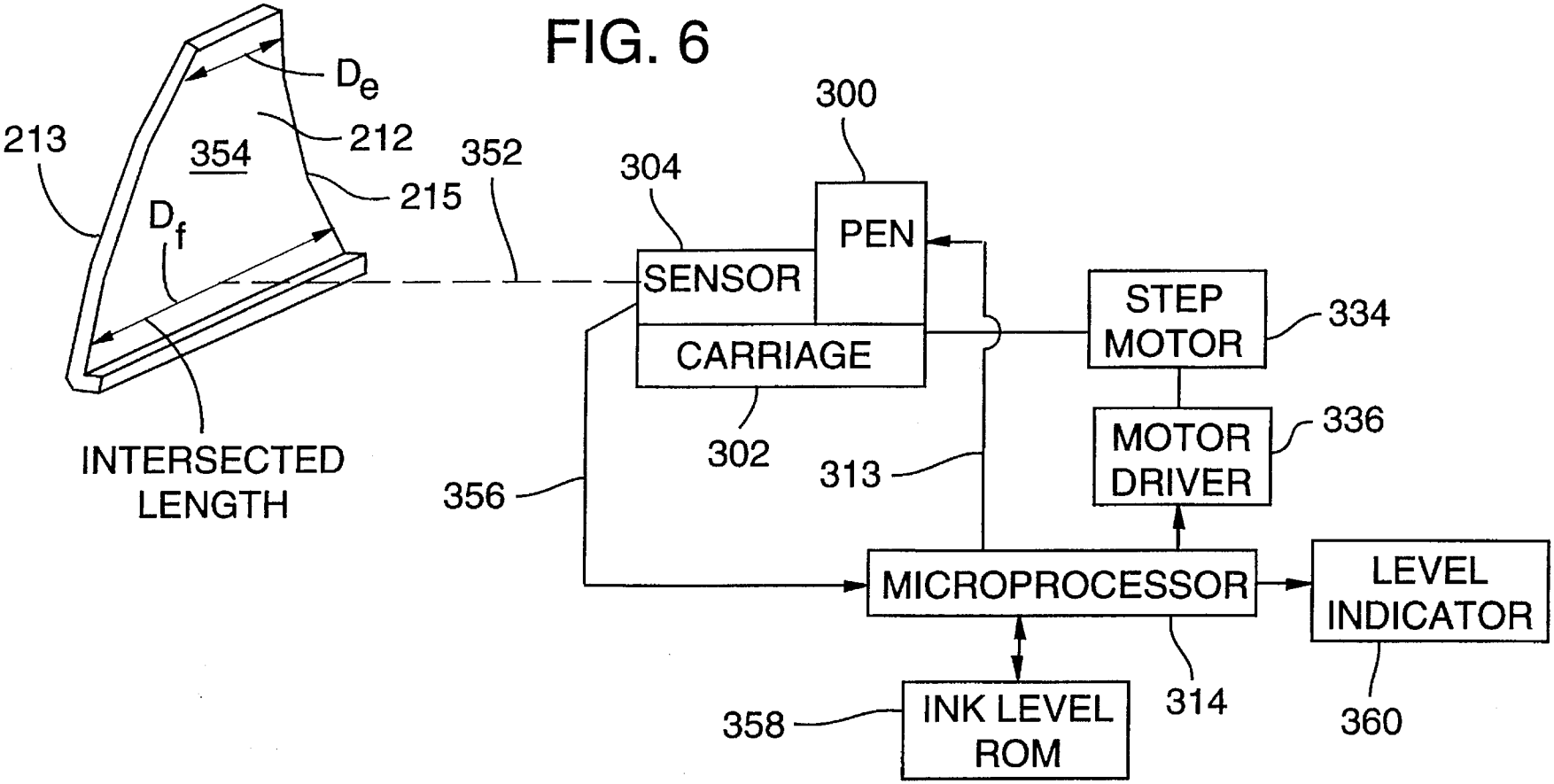
FIG. 6 is a diagram showing the components for operating and controlling the system.

The suction that is generated as ink drops are ejected through the print head 310 draws ink from the reservoir 308 through the channels to the print head to replace the ink just ejected. Electrically conductive leads (not shown) extend from the resistors and are grouped on a flexible circuit that is bonded to the exterior of the pen. The circuit is placed in electrical communication with the printer microprocessor 314 by known means (such as a ribbon-type multiconductor 313 (FIG. 6). The printer microprocessor 314 controls the operation of the print head.

In one preferred embodiment, the interior of the pen reservoir 308 is substantially filled with a foam 320. The foam 320 has sufficient capillarity to prevent the ink from leaking through the print head, but the capillarity is overcome by the suction developed in the print head as ink is ejected. The capillarity of the foam, therefore, establishes a back pressure at the print head for restricting ink flow through the print head in the absence of print head operation.

In a preferred embodiment (FIG. 5) a tubular standpipe 322 extends between the foam 320 and the print head 310. At the junction of the standpipe 322 and the foam 320 the standpipe is covered with a fine-mesh screen 324 that serves to prevent air bubbles from entering the standpipe 322 and to filter particles from the ink in the reservoir as the ink passes through the screen to the print head.

The foam 320 within the pen reservoir 308 is periodically replenished with ink that is conducted through the supply tube 190. The end of the tube 190 away from the ink cartridge 10 may be permanently connected to the reservoir 308, or periodically connected to the reservoir 308 only during the time the reservoir is refilled. The flow of ink through the tube may be controlled by valving, such as a small electronically operated valve 189 (FIG. 1) that is controlled by the printer microprocessor for selectively opening and occluding ink flow through the tube 190 to the reservoir 308. The valve 189 may be mounted, as shown in FIG. 1, to the ink cartridge station 150. The microprocessor 314 determines the appropriate intervals for opening the valve 189 (as, for example, by monitoring the number of times that the resistors of the print head are fired, hence maintaining a "drop count" that is indicative of the amount of ink expelled from the pen 300). When the valve 189 is open, ink is permitted to flow from the cartridge 10 to the pen reservoir 300.

The pen is removably mounted to the carriage 302 in an orientation such that the print head 310 faces the paper. The carriage reciprocates across the printer (adjacent to paper that is advanced through the printer) along the linear path 306 (FIG. 1). The carriage movement is guided by one or more guide rods 376 along which the carriage slides.

The carriage 302 also includes a protruding drive bracket 328 (FIG. 5). Between the bracket 328 and the carriage fits an endless, toothed drive belt 330. The teeth of the drive belt mesh with inwardly protruding teeth on the drive bracket 328, thereby fixing the position of the belt 330 relative to the frame 326. The drive belt 330 engages a pulley 332 on the shaft of a reversible, variable-speed DC step motor 334.

The step motor driver 336 (FIG. 6) is precisely controlled by the microprocessor 314 so that the position of the carriage is determined with very high resolution. Put another way, the carriage movement distance along its path 306 is precisely controlled and monitored by the microprocessor 314, as is necessary for printing recognizable characters as the pen is rapidly moved across the paper. In the present invention, the availability of the high-resolution carriage position information is used in conjunction with information received from the next-described sensor 304 and flag 212 arrangement to provide the ink level detection of the present invention.

The flag 212, connected as described earlier to the pressure bar 200 (hence, to the ink cartridge 10), moves (downwardly in FIG. 3) as the cartridge is depleted of ink. In this regard, the following portion of the description pertains to the operation of the station 150 during which time the pressure bar 200 is applied to the cartridge to move ink therefrom. The sensor 304 is mounted to the carriage 302 and detects the movement of the flag 212 as the cartridge collapses, thereby to provide an indication of the level of ink remaining in the cartridge.

More specifically, the flag 212 is configured and arranged to protrude upwardly from the cartridge 10. At least part of the flag 212 intersects a plane that is perpendicular to the plane of FIG. 3 and in which plane reside both dashed lines 350 and 352 (FIG. 1). Dashed line 350 represents a line parallel to the carriage path 306. Dashed line 352 represents the central ray of a signal beam emitted by the sensor 304 that is mounted to the carriage. That beam 352 is scanned with carriage motion along the carriage path.

The sensor 304 may be any conventional optoelectronic device comprising a light-emitting or IR-emitting diode with adjacent phototransistor, the output of which phototransistor turns to an "ON" state when the signal emitted from the sensor is reflected back to the phototransistor.

The part of the flag 212 that intersects the plane in which beam 352 lies has an inner surface 354 facing the sensor 304 and that serves as a retroreflector. Accordingly, this surface 354 causes the incident beam 352 to be reflected along a path parallel to that beam 352 so that the reflected beam may be received by the phototransistor component of the sensor. The flag surface 354 is concavely curved so that the beam 352 always returns to the sensor 304 irrespective of the downward movement of the flag (See FIGS. 3 and 4).

As the carriage is moved by the step motor 334 along the carriage path 306, the beam 352 emitted by the sensor 304 will impinge upon the flag 212 and traverse the width of the flag along what may be termed an intersected length, such as shown at $D_f$ in FIG. 1. This intersected length is, therefore, the width of the flag 212 at the location on the flag where the flag intersects the plane in which resides the beam 352. Put another way, the intersected length is that length traversed by the beam 352 across the flag from one side edge 213 of the flag to the other side edge 215. As explained next, this intersected length changes with the flag movement, that is, as the flag moves downwardly during ink depletion from the cartridge.

Figure 4:
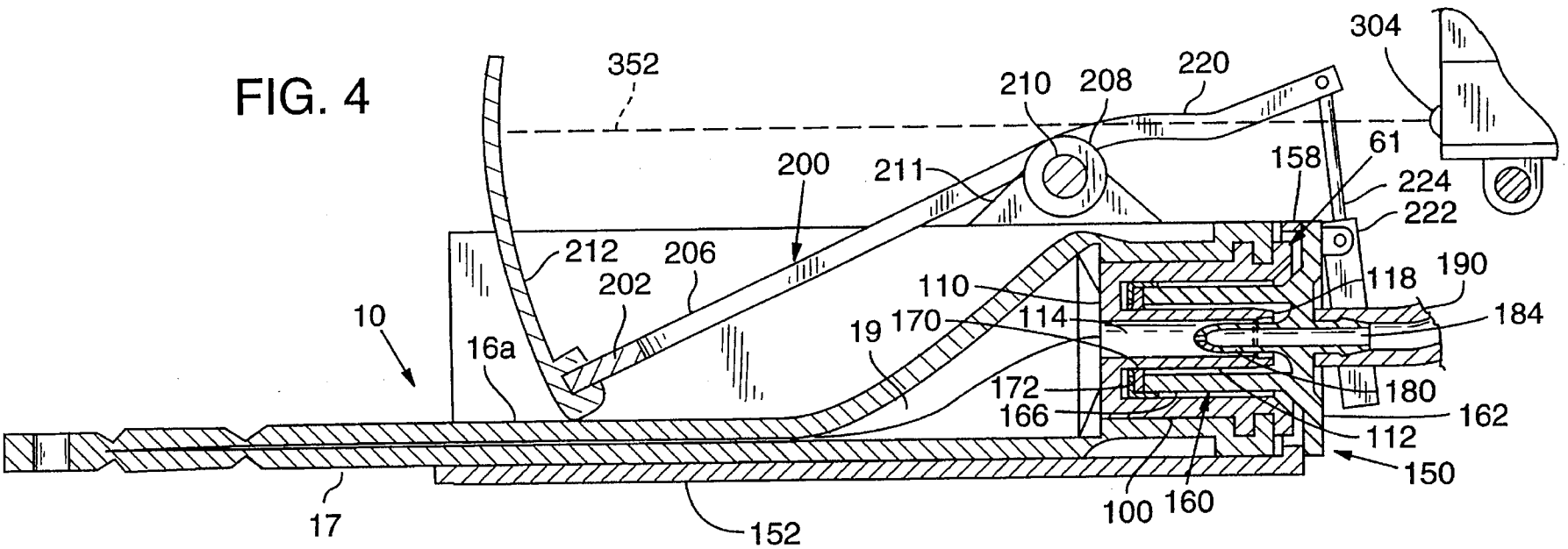
FIG. 4 is a side view of the system, partly in section, showing the ink cartridge in an empty, collapsed configuration.

In a preferred embodiment, the flag 212 is tapered so that its width diminishes in the direction away from the bar 202 to which it is attached. Consequently, the intersected length associated with the flag (that is, the distance across which the sensor returns an ON signal as the sensor is scanned by the carriage adjacent to the flag) reduces as the flag moves downwardly with the collapsing ink cartridge 10. In the depicted embodiment, the intersected length changes from a maximum distance $D_f$, which is indicative of a full cartridge, to a minimum length $D_e$, which is indicative of a substantially empty cartridge (FIG. 4).

When the incident beam 352 is reflected back to sensor 304 the sensor switches to an ON state and a corresponding "ON" signal output is provided to the microprocessor 314 along line 356 (FIG. 6). With reference to FIGS. 1 and 6, the intersected length can be precisely measured in the microprocessor 314 by notation of the extent to which the step motor 334 is driven during the time in which an "ON" signal is received from the sensor 304. The carriage movement distance is correlated to the amount of ink depleted from the cartridge via a look-up table stored in memory 358. The look-up ink level may be displayed on any suitable indicator 360, such as a light-emitting diode (LED) on the printer body.

It will be appreciated by one of ordinary skill in the art that any of a variety of sensor components may be employed for detecting the intersected length of the flag. Moreover, the sensor components can be arranged differently than described above. For example, the flag can be configured in any of a variety of shapes that will result in different intersected lengths at different positions of the flag relative to the carriage path 306.

Further, the retroreflective component may be located elsewhere than on the flag. For example, the retroreflective component may be mounted to the printer body and arranged so that the path between the sensor and the retroreflective component would be interrupted by the flag. As a result, the microprocessor 314 is provided with an "OFF" signal from the sensor as the beam is scanned across the intersected length of the flag. The correlation between the carriage movement distance and "OFF" signal duration will yield the ink level.

Although a single cartridge and flag have been depicted in the preferred embodiment, it will be appreciated that more than one cartridge and flag may be located in the vicinity of the carriage path and, therefore, a level indication corresponding to each cartridge may be provided.

It is also contemplated that the cartridge may be arranged so that a connected flag moves in a direction generally parallel to that of the carriage motion. In such an arrangement, the intersected length, as defined above, may not change with flag movement, although the change in position of an edge of the flag relative to the carriage path would be readily determined by the microprocessor for noting the amount of flag movement and, hence, the remaining ink level in the cartridge.

The foregoing has been described in connection with preferred and alternative embodiments. It will be appreciated by one of ordinary skill in the art, however, that various modifications and variations may be substituted for the mechanisms and method described here while remaining defined by the appended claims and their equivalents.

The invention claimed is:

1. An ink level detection system for an ink-jet printer that has a reciprocating carriage that moves in a path, comprising:

a cartridge that contains ink and that collapses as ink is depleted from the cartridge;

a flag member connected to the cartridge to move relative to the carriage path as the cartridge collapses; and a sensor mounted to the carriage for detecting the movement of the flag member, the carriage and sensor moving together relative to the cartridge.

2. The system of claim 1 wherein the flag member is located to have a part of the flag member intersect a first plane that is parallel to the carriage path, thereby defining an intersected length of the part where that part intersects the plane, the intersected length changing as the flag member moves relative to the carriage path, and wherein the sensor detects the intersected length.

3. The system of claim 2 wherein the sensor emits a signal that impinges upon the flag member at a location such that movement of the sensor with the carriage traverses the signal along the intersected length.

4. The system of claim 2 wherein the sensor is coupled to a retroreflective component that intersects the first plane.

5. The system of claim 4 wherein the retroreflective component is carried on the flag member.

6. The system of claim 3 wherein the sensor is coupled to a retroreflective component that intersects the first plane.

7. The system of claim 6 wherein the retroreflective component is carried on the flag member.

8. The system of claim 2 including detection means for moving the carriage and determining a carriage movement distance that the carriage moves as the signal traverses the intersected length of the flag member part, thereby to correlate the carriage movement distance to an amount of ink depleted from the cartridge.

9. The system of claim 1 wherein the flag member is located to have a part of the flag member intersect a plane that is parallel to the carriage path, thereby defining an intersected length of the part where that part intersects the plane, the intersected length moving relative to the carriage path as the flag member moves relative to the carriage path, and wherein the sensor detects the movement of the intersected length.

10. A method of detecting the quantity of ink in a cartridge that contains ink and that collapses as ink is depleted from the cartridge, wherein the cartridge is mounted proximal to a printer carriage that moves along a path toward and away from the cartridge, the method comprising the steps of:

connecting to the cartridge a flag member that moves relative to the carriage path as the cartridge collapses;

mounting on the carriage a sensor that moves with the carriage detecting the movement of the flag member relative to the carriage path by measuring with the moving sensor a dimension of the flag member.

11. The method of claim 10 wherein a part of the flag member intersects a plane that is parallel to the carriage path, and wherein the length of the intersection of the part and the plane changes as the flag member moves relative to the carriage path, and wherein the detecting step includes detecting the length of the intersection.

12. The method of claim 11 wherein the detecting step includes:

arranging the sensor to emit a signal that impinges upon the flag member at a location such that movement of the sensor with the carriage traverses the signal along an intersection length;

moving the carriage; and determining a carriage movement distance that the carriage moves as the signal traverses the intersection length of the flag member, thereby to correlate the carriage movement distance to an amount of ink depleted from the cartridge.

13. The method of claim 11 wherein the detecting step includes coupling a retroreflective component to the sensor.

* * * * *